United States Patent [19]

Jefferson et al.

[11] 4,380,223

[45] Apr. 19, 1983

[54] LIQUID FUEL INJECTION PUMPING APPARATUS

[75] Inventors: John R. Jefferson, Rainham; Robert T. J. Skinner, High Wycombe, both of England

[73] Assignee: Lucas Industries Limited, Birmingham, England

[21] Appl. No.: 230,270

[22] Filed: Jan. 30, 1981

[30] Foreign Application Priority Data

Feb. 14, 1980 [GB] United Kingdom ..... 8004951

[51] Int. Cl.[3] ..... F02M 59/30

[52] U.S. Cl. ..... 123/383; 123/387; 123/504

[58] Field of Search ..... 123/382, 383, 386, 387, 123/504; 417/462

[56] References Cited

U.S. PATENT DOCUMENTS 4,050,437 9/1977 Hollett et al. ..... 123/504

4,154,204 5/1979 Bonin ..... 123/382

FOREIGN PATENT DOCUMENTS 36858 10/1971 Japan ..... 123/504

*Primary Examiner*—Tony M. Argenbright

[57] ABSTRACT

A liquid fuel injection pumping apparatus includes a plunger movable inwardly in a bore to deliver fuel, by the action of a roller and a cam. An adjustable stop ring is provided to limit the extent of outward movement by the plunger and hence the maximum amount of fuel which can be supplied to the associated engine. The ring is positioned by a piston upon which liquid under pressure can act. The liquid under pressure is supplied by a low pressure pump and is admitted to one end of a cylinder containing the piston through a restrictor. The pressure downstream of the restrictor is controlled by a valve which includes a valve member spring biased into contact with a seating against the action of the pressure downstream of the restrictor. The air pressure in the engine inlet manifold is applied to a diaphragm and the force developed assists the action of the spring biasing the valve member.

4 Claims, 3 Drawing Figures

LIQUID FUEL INJECTION PUMPING APPARATUS

This invention relates to a liquid fuel injection pumping apparatus for supplying fuel to a turbo supercharged compression ignition engine and of the kind comprising a housing, a rotary distributor member located in the housing and adapted in use, to be driven in timed relationship with an associated engine, a reciprocable pump plunger located in a bore in the distributor member, a cam located in the housing for imparting inward movement to the plunger as the distributor member rotates, means for feeding fuel to the bore to effect outward movement of the plunger, passage means for conveying fuel from the bore to an outlet during inward movement of the plunger, a movable member operable in use to determine the maximum outward movement of the plunger and means responsive to the pressure of air delivered to the associated engine in use, for determining the setting of said movable member.

It is known that when such an apparatus is used to supply fuel to a compression ignition engine, the maximum amount of fuel which can be supplied to the engine at each delivery stroke of the apparatus should be varied in accordance with the pressure of air delivered to the engine by the turbo super-charger. This is to allow full use of the power potential of the engine with no more than the permitted level of smoke in the engine exhaust.

It is known to provide a spring loaded diaphragm which is directly coupled to said movable member and to subject the diaphragm to the pressure of air delivered by the turbo super-charger. In order to provide sufficient force to move the movable member it has been necessary to provide a diaphragm having an area such that the casing for the diaphragm has an appreciable size, thereby making it difficult to mount the casing on the housing of the apparatus.

The object of the present invention is to provide an apparatus of the kind specified in a simple and convenient form.

According to the invention in an apparatus of the kind specified said pressure responsive means comprises a piston housed within a cylinder, means coupling said piston to said movable member, a source of liquid under pressure, a conduit connecting said source to said cylinder and valve means operable to control the liquid pressure in said cylinder, said valve means in use being responsive to the pressure of air supplied to the associated engine.

An example of an apparatus in accordance with the invention will now be described with reference to the accompanying drawings in which.

Figure 1:
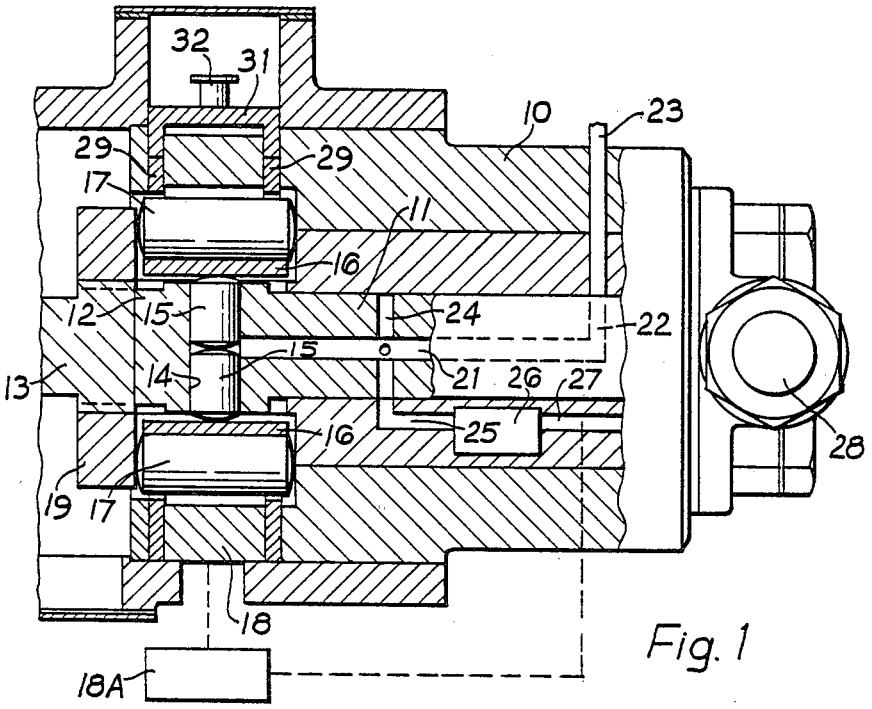
FIG. 1 is a diagrammatic sectional side elevation of the apparatus.

Referring to FIG. 1 of the drawings, the apparatus comprises a multi-part housing 10 in which is mounted a rotary cylindrical distributor member 11. The distributor member has an enlarged portion 12 which is driven from a drive shaft 13 the latter in use being driven in timed relationship with the associated engine. Formed in the distributor member 11 is a diametrically disposed bore 14 in which is mounted a pair of plungers 15 which at their outer ends, engage shoes 16 respectively which carry rollers 17 for engagement with the internal peripheral surface of an annular ring 18 surrounding the enlarged portion 12 of the distributor member.

Figure 2:
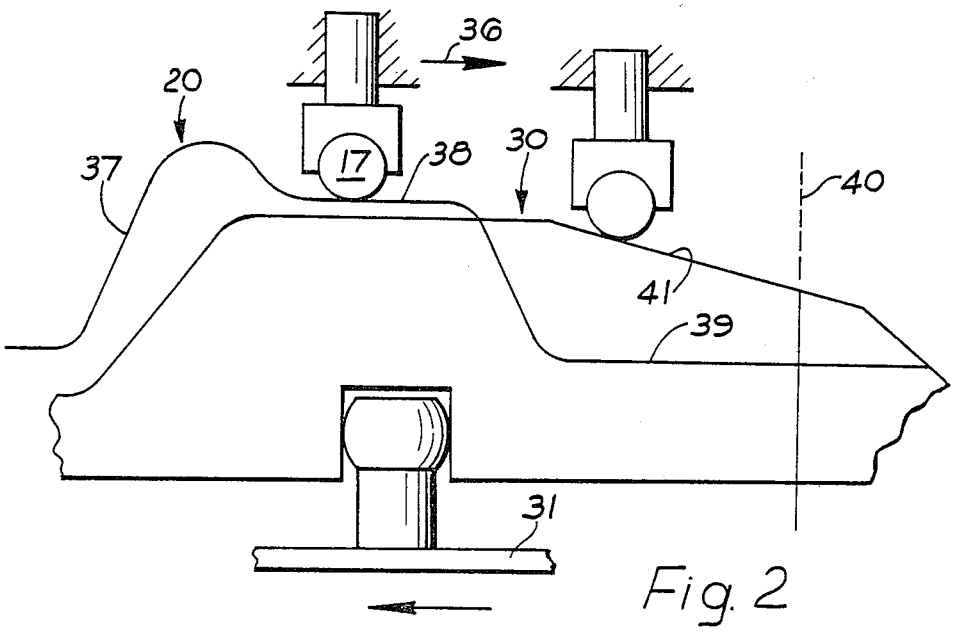
FIG. 2 is a diagram of the cam lobe profile and a profile of a stop ring forming part of the apparatus of FIG. 1.

The cam ring 18 has a plurality of inwardly extending cam lobes the profile of one of which is seen at 20 in FIG. 2. The shoes 16 are carried in slots formed in a sleeve 19 which is secured to or forms part of the drive shaft 13.

Formed within the distributor member is a longitudinal passage 21 which at one end communicates with a radially disposed delivery passage 22. The passage 22 is disposed to register in turn with outlet ports 23 formed in the body and connected in use to the injection nozzles respectively of the associated engine. The longitudinal passage 21 also communicates with a plurality of inlet passages 24 which are formed in the distributor member and which are arranged to communicate in turn with an inlet port 25 which is formed in the housing 10. The inlet port 25 communicates by way of a fuel control device 26 conveniently comprising an adjustable throttle, with a fuel supply passage 27. This passage communicates with the outlet of a low pressure supply pump the rotary part of which is carried by the distributor member. The low pressure pump draws fuel through an inlet 28 and conveniently a relief valve is provided whereby the outlet pressure of the low pressure pump is controlled in a manner so that it varies in accordance with the speed at which the apparatus is driven.

In operation, when the rollers and plungers are moved inwardly by the action of the cam lobes, fuel is displaced through an outlet 23 and as the distributor member rotates further, the delivery passage 22 is moved out of register with an outlet 23 and one of the inlet passages 24 moves into register with the inlet port 25. Fuel can now flow to the bore 14 the amount of fuel being controlled by the setting of the throttle. Thereafter the cycle is repeated and fuel is supplied to the outlets in turn during successive inward movements of the plungers.

Figure 3:
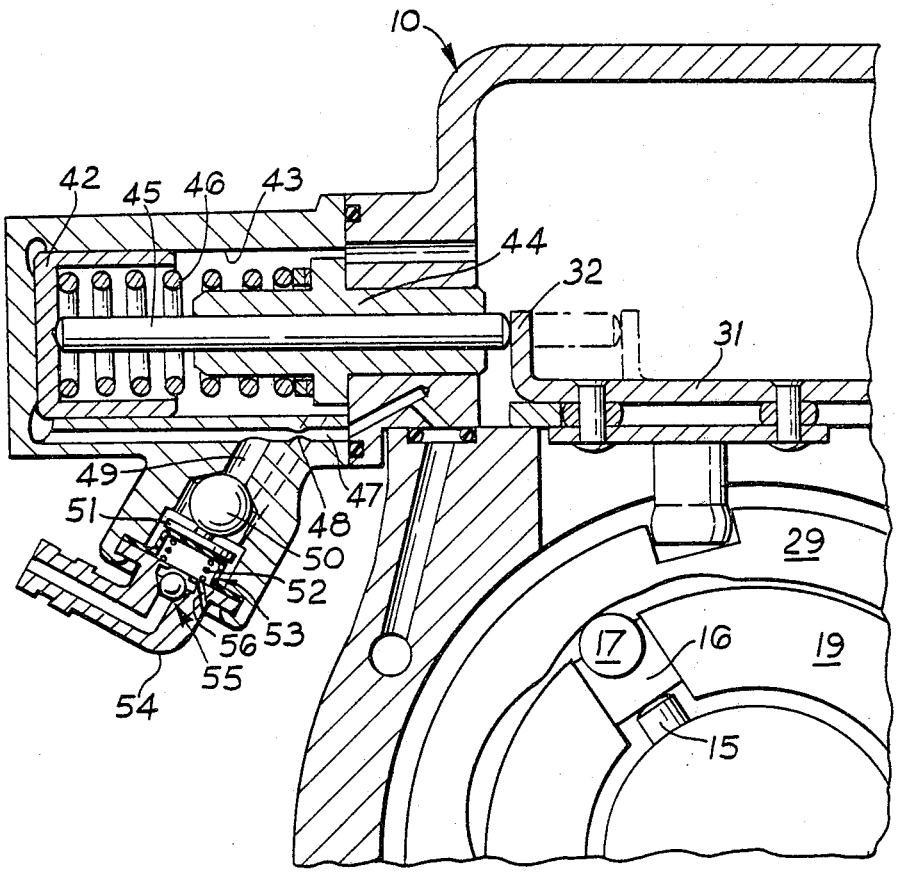
FIG. 3 is a part sectional side elevation showing part of a practical construction of the apparatus of FIG. 1.

In order to control the maximum amount of fuel which can be supplied by the apparatus to the associated engine irrespective of the setting of the throttle, there is mounted in the housing 10, a pair of stop rings 29, these rings are disposed on opposite sides of the cam ring 18 and are angularly movable within the housing. They have an internal profile as shown at 30 in FIG. 2. The stop rings are interconnected by means of a bridging member 31 which is provided with an up-standing projection 32. As will be explained, the projection 32 can be moved to the dotted position shown in FIG. 3 and during such movement angular movement will be imparted to the rings 29.

Turning to FIG. 2 which is a developed view, the plungers and rollers move in the direction of the arrow 36 and it will be noted that each cam lobe has a leading flank 37 which when the roller is engaged therewith, will effect inward movement of the rollers and plungers, a crest portion which is followed by a dwell portion 38 and a further dwell portion 39. When the rollers ride over the crest, no more fuel is displaced to the engine and the limited outward movement of the rollers before they engage the dwell 38, permits the delivery valves of the apparatus and also the valves in the injection nozzles, to close. Moreover, during this period the delivery passage 22 moves out of register with an outlet 23 and this is followed by an inlet passage 24 moving into register with the inlet 25. The position at which an inlet passage is moved out of register with the inlet port is indicated at 40. The stop rings 30 have an internal profile which includes an outwardly extending portion 41 and the portion 41 acts to limit the extent of outward movement of the rollers and hence the plungers. It will be noted that the rollers and plungers can still move outwardly up to the position at which the inlet passage moves out of register with the inlet port but when this communication is broken no further outward movement, at least of the plungers, can take place. Moreover, it should be noted that there may be conditions of engine operation when the rollers do not engage the portion 41 for example, when the fuel control device is more or less closed.

If from the positions of the rings shown in FIG. 2, the rings are moved towards the left, then the plungers will be allowed an increased outward movement and hence the maximum amount of fuel which can be supplied to the engine will be increased. Conversely if the rings are moved towards the right, then the extent of outward movement is decreased.

As explained above when the pressure of air which is supplied to the engine increases, more fuel can be satisfactorily burnt in the combustion chambers of the engine thereby allowing the engine to develop an increased power. It is therefore necessary to adjust the rings 29 in accordance with the pressure of air supplied to the engine and turning to FIG. 3, a piston 42 is provided which is housed within a cylinder 43 secured on one side of the housing 10 of the apparatus. The housing also supports a bush 44 and extending through the bush is a bore in which is located a push rod 45. The push rod 45 is engaged at one end with the piston 42 and at its other end with the projection 32. Moreover, the piston 42 is biassed towards one end of the cylinder 43 by means of a coiled compression spring 46.

Liquid under pressure is delivered to the aforesaid one end of the cylinder 43 by way of a conduit 47. Conveniently the source of liquid under pressure is the low pressure pump which supplies fuel to the passage 27. The conduit 47 incorporates a fixed restrictor 48 and downstream of the restrictor 48 the conduit 47 communicates with a branch conduit 49 which opens into a chamber. The end of the conduit 49 in the chamber defines a seating for a ball 50 and the chamber communicates with a drain conveniently a space within the housing of the apparatus.

The ball 50 is engaged by a projection carried by a plate 51 and the plate 51 is biassed by a spring 52 in such a manner that the ball 50 is urged onto the seating. The plate 51 is subject, in use, to the outlet pressure of the turbo super-charger in a manner such that the pressure of air developed by the turbo super-charger assists the action of the spring 52 in biassing the ball 50 into contact with its seating. Conveniently a flexible cup-shaped member 53 is provided having an outwardly extending flange portion which is retained between two parts of the housing. The interior of the cup-shaped member is exposed to the pressure of air supplied to the engine by way of a passage formed in a suitable connector 54 and which is connected to the inlet manifold of the associated engine. The aforesaid passage includes a non-return valve generally indicated at 55 the purpose of which is to prevent the flow of fuel towards the inlet manifold of the engine in the event of rupture of the member 53.

In use, when the pressure of air delivered by the turbo super-charger is low, the forces acting to retain the ball 50 on its seating are comparatively low and hence the ball will be lifted from its seating by the liquid pressure downstream of the restrictor 47, the pressure downstream of the restrictor 47 will therefore be controlled and the piston 42 will assume an equilibrium position within the cylinder 43 as determined by the force acting on the piston 42 due to the liquid pressure and opposed by the force exerted by the spring 46. Any movement of the piston 42 away from the aforesaid one end of the cylinder 43 will be transferred to the projection 32 and the rings 29 will move in a direction to increase the amount of fuel which can be supplied to the engine. As the pressure of air delivered by the turbo super-charger increases, the force acting on the ball 50 will also increase and as a result the pressure downstream of the restrictor 47 will also increase. This increase in the liquid pressure will effect movement of the piston 42 away from said one end of the cylinder. As the pressure of air decreases the balls will move away from its seat and air can escape from the chamber defined by the member 53, upon closure of the valve 55 through a restricted orifice 56.

Although not shown, there would be associated with the projection 32 a spring which acts to maintain the projection in contact with the push rod 45. It will be noted that if the connection between the connector 54 and the air inlet manifold is broken, then the piston 42 will move to reduce the maximum amount of fuel which can be supplied to the engine.

We claim:

1. A liquid fuel injection pumping apparatus for supplying fuel to a turbo supercharged compression ignition engine and of the kind comprising a housing, a rotary distributor member located in the housing and adapted, in use, to be driven in time relationship with an associated engine, a reciprocable pump plunger located in a bore in the distributor member, a cam located in the housing for imparting inward movement to the plunger as the distributor member rotates, means for feeding fuel to the bore to effect outward movement of the plunger, passage means for conveying fuel from the bore to an outlet during inward movement of the plunger, a movable member operable, in use, to determine the maximum outward movement of the plunger, means responsive to the pressure of air delivered to the associated engine, in use, for determining the setting of said movable member, said pressure responsive means comprising a piston housed within a cylinder, means coupling said piston to said movable member, a source of liquid under pressure, a conduit connecting said source to said cylinder, and valve means operable to control the liquid pressure in said cylinder and, in use, being responsive to the pressure of air supplied to the associated engine, a restrictor in said conduit, said conduit being connected to said cylinder downstream of said restrictor, said valve means acting to control the flow of liquid from downstream of said restrictor to a drain and comprising a seating, a valve member, resilient means acting on said valve member to urge the valve member into contact with said seating against the action of the pressure downstream of said restrictor, and pressure responsive means subjected, in use, to the pressure of air supplied to the engine, the force exerted on said pressure responsive means by the air pressure acting to assist the action of said resilient means.

2. An apparatus according to claim 1 in which said pressure responsive means comprises a flexible diaphragm, the edge of said diaphragm being retained between two parts of a valve housing, one of said housing parts defining said seating and the other part of the housing defining a connector including a passage which in use is connected to the inlet manifold of the engine.

3. An apparatus according to claim 2, including a plate located between the diaphragm and the valve member, the valve member being in the form of a ball.

4. An apparatus according to claim 2 or claim 3, including a non-return valve in said passage, said non-return valve being arranged to close to prevent flow of liquid through said passage in the event of rupture of said diaphragm.

* * * * *